United States Patent [19]

Föcke

[11] Patent Number: 4,652,329

[45] Date of Patent: Mar. 24, 1987

[54] APPARATUS FOR JOINING SHEETS OF PACKAGING MATERIAL

[75] Inventor: Heinz Föcke, Verden, Fed. Rep. of Germany

[73] Assignee: Focke & Co., Verden, Fed. Rep. of Germany

[21] Appl. No.: 774,687

[22] Filed: Sep. 11, 1985

[30] Foreign Application Priority Data

Oct. 26, 1984 [DE] Fed. Rep. of Germany ..... 3439313

[51] Int. Cl.[4] ..... B65H 19/18; B65H 19/20; B65H 21/02

[52] U.S. Cl. ..... 156/351; 156/353; 156/504; 156/505; 242/56 R; 242/58.4; 242/58.5

[58] Field of Search ..... 156/504, 505, 351, 353, 156/157, 159, 502; 242/56 R, 58.1, 58.4, 58.5

[56] References Cited

U.S. PATENT DOCUMENTS

| | | | |
|---|---|---|---|
| Re. 29,365 | 8/1977 | Butler, Jr. | 156/504 |
| 3,995,791 | 12/1976 | Schoppee | 156/505 |
| 4,010,911 | 3/1977 | Heitmann | 156/505 |
| 4,100,012 | 7/1978 | Meihofer et al. | 156/504 |
| 4,190,483 | 2/1980 | Ryan et al. | 156/505 |
| 4,390,388 | 6/1983 | Nagata et al. | 156/504 |

*Primary Examiner*—Michael Wityshyn

*Attorney, Agent, or Firm*—Sughrue, Mion, Zinn, Macpeak, and Seas

[57] ABSTRACT

In an apparatus for joining the ends of sheets of material 10, 11, consisting especially of packaging material, a sheet-holder 28 assigned to the running-off sheet of material 10 is moved with the sheet of material in the direction of a second sheet-holder 29, the running-off sheet of material being severed and the rear end being joined to the front end 38 of the sheet of material 10 to be connected. The to-and-fro movements of the sheet-holders 28, 29 are executed by means of pressure-medium cylinders 48 which can be controlled by sensor units 22, 23 assigned to the sheets of material 10, 11.

4 Claims, 3 Drawing Figures

APPARATUS FOR JOINING SHEETS OF PACKAGING MATERIAL

BACKGROUND OF THE INVENTION

The invention relates to an apparatus for joining a first running-off sheet of material to the front end of a second sheet of material to be connected, each sheet of material having assigned to it a transversely movable, especially pivotable sheet-holder, of which the first sheet-holder fixing the running-off first sheet of material can be advanced to the second sheet-holder fixing a front end of the second sheet of material to be connected, the first running-off sheet of material thereby being severed.

In an apparatus of this type which is known in practice, the sheet-holders for the first and second sheets of material are of plate-shaped design and are arranged approximately in the form of a V relative to one another in the initial positions. The running-off sheet of material is conveyed through a gap between the pivot bearings of the pivotable sheet-holders. The surfaces of the latter which face one another serve for the temporary fixing of the associated sheet of material or of a front end of the latter. In this known apparatus, when the first sheet of material drawn off from a reel has run off, the sheet-holder is pivoted in the direction of the opposite sheet-holder in response to an appropriate signal. During this movement, the sheet of material running off further is severed when a severing knife located on the sheet-holder, taking up the running-off sheet, is moved past a fixed counter-knife arranged between the sheet-holders and the running-off sheet is thereby severed. The rear end of the running-off sheet of material, this rear end resting against the sheet-holder which continues to pivot, is pressed against the side of the opposite second sheet-holder facing it or against the front end, fixed there, of the sheet to be connected. The sheet ends are joined together by means of an adhesive tape or the like, and at the same time the second sheet of material to be connected is set in forward motion and now runs off.

In the known apparatus, the sheet-holders are actuated by hand. Certain operational and control problems arise because of this.

SUMMARY OF THE INVENTION

The object on which the invention is based is to develop further and improve an apparatus of the known design, in such a way that the cycles of movement when the sheets of material are changed are executed more reliably and more accurately.

To achieve this object, the apparatus according to the invention is characterised in that the particular movable sheet-holder can be actuated by the first running-off sheet of material, especially via a pressure-medium cylinder.

The apparatus according to the invention no longer requires manual involvement to change the sheets of material and join the sheet ends to one another. The movement of the sheet-holders relative to one another, especially as a result of pivoting, is ensured by means of pressure-medium cylinders assigned to each sheet-holder. The pressure-medium cylinders in turn are controlled by means of the running-off sheet of material, the rear end of which is sensed by (photoelectric) sensors.

As a result of the movement of the sheet-holders, further switching or control operations are triggered automatically. A slide is shifted from one end position into the opposite end position by the particular sheet-holder which is moved, and in the respective end position a switching means is actuated, in particular an initiator stressed. This in turn triggers several operations related to the change of the sheets of material. In particular, the working speed of the associated packaging machine is temporarily reduced. Furthermore, a sensor unit assigned to the particular sheet running off is switched on. Finally, the suction air for fixing the front end of the second sheet of material to be connected to the associated second sheet-holder is switched off. At the same time, the suction air in the region of the opposite first sheet-holder is switched on.

A further special feature is that the particular sheet-holder, during its movement towards the adjacent sheet-holder, is guided in the region of the counter-knife arranged centrally between the sheet-holders and is consequently maintained in an exact relative position in relation to this.

BRIEF DESCRIPTION OF THE DRAWINGS

Further details of the invention are explained in more detail below with reference to an exemplary embodiment illustrated in the drawings.

In the drawings.

DETAILED DESCRIPTION OF A PREFERRED EMBODIMENT

Figure 1:
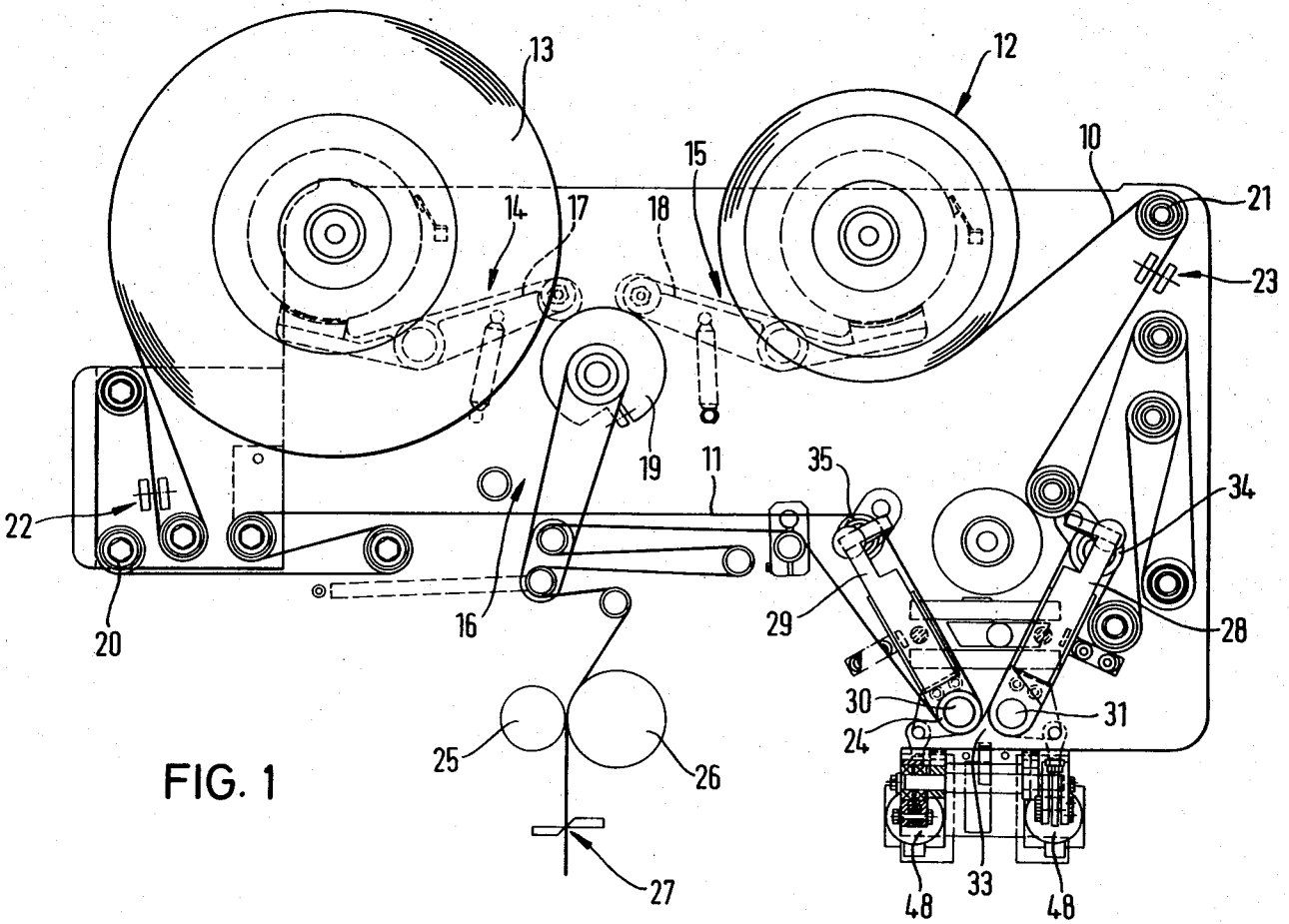
FIG. 1 shows a general diagrammatic view of the apparatus for changing sheets of material.

The apparatus is preferably used in conjunction with a packaging machine. The problem is to join a first running-off sheet of material 10 to a second sheet of material 11 which is in a stand-by position, and to introduce the latter into the production process. The sheets of material 10, 11 are preferably packaging material, for example tin foil, paper or the like. The first sheet of material 10 is drawn off from a first reel 12 and the second sheet of material 11 from a second reel 13. Assigned to each reel is a shoe brake 14, 15 which is actuated in a known way by a rocker 16 according to the tension in the running-off sheet of material 10. Spring-loaded two-armed brake levers 17, 18 are supported on a cam disc 19 actuated by the rocker.

Following the reel 12, 13, each of the two sheets of material 10, 11 is guided via a plurality of deflecting rollers 20 and 21. Located after the first deflecting roller assigned to the reel 12, 13 is a device for monitoring the running sheet of material, in particular a (photoelectric) sensor unit 22 and 23. This senses essentially the (rear) end of, or makings on, the associated sheet of material 10, 11 when the latter is in the position of the running-off sheet of material. Furthermore, these sensor units 22, 23 monitor the sheets of material 10, 11 for any defects, for example tears, holes, etc.

The sheets of material 10, 11 are fed via further deflecting rollers 20 and 21 to a central deflecting roller 24 common to both sheets of material 10, 11. From here, the particular sheet of material running off—in the exemplary embodiment illustrated, the sheet of material 10—is supplied to the rocker 16 and finally guided over a pair of draw rollers 25, 26. The running-off sheet of material 10 is drawn off or transported by these. The draw rollers 25, 26 are followed by a severing device 27 for severing blanks from the sheet of material 10.

In the region of the central deflecting roller 24, the sheets of material 10 and 11 are joined to one another when the first sheet of material 10 is about to run off, that is to say the reel 12 is about to run empty, and the second sheet of material 11 in the stand-by position is to be connected.

A sheet-holder 28, 29 is assigned to each sheet of material 10, 11. These are of essentially plate-shaped design, specifically with a width greater than the width of the sheet of material 10, 11 (see FIG. 3). In the initial position, the sheet-holders 28, 29 are directed in the form of a V relative to one another, converging in the conveying direction of the sheets of material 10, 11. The sheet-holders 28, 29 are mounted pivotably, in particular on bearing journals 30, 31, at the lower edges. The bearing journal 30 assigned to the second sheet-holder 29 serves also for receiving the central deflecting roller 24. As is evident from FIG. 3, the sheet-holder 29 is mounted on the bearing journal 30 laterally next to the deflecting roller 24. The deflecting roller 24 extends in a recess 32 in the edge of the sheet-holder, so that the sheet of material 11 can be guided in the region of the sheet-holder 29 and the central deflecting roller 24.

In the lower region, the distance between the sheet-holders 28, 29 or the bearing journals 30, 31 is relatively small, so that a narrow gap 33 for the passage of one sheet of material 10, 11 or the other is formed.

On the side located opposite the lower ends, a further deflecting roller 34, 35 is provided at the (top) edge of each of the sheet holders 28, 29, for deflecting the sheet of material 10 or 11 into the plane of the front sides of the sheet-holders 28, 29.

The sheets of material 10, 11 are guided along (running-off sheet of material 10) on retaining surfaces 36, 37 of the sheet-holders 28, 29 or are fixed to these. The latter possibility is intended for a front end 38 of the second sheet of material 11 which is in the stand-by position.

In the present case, the retaining surfaces 36, 37 are provided with a projecting elastic coating, especially a rubber coating 39. In the region of this, the sheet of material or the front end 38 of the latter is held by suction air. For this purpose, suction bores 40 open out in the region of holes 41 in the rubber coating 39. The sheet of material 10 or 11 is fixed over approximately its entire width by means of a transversely directed row of such suction bores 40 or holes 41. The suction bores 40 are connected to a vacuum source by means of a suction line 42.

Each sheet-holder 28, 29 is provided with a severing knife 43, 44. As a result of the relative movement of the sheet-holder 28 receiving the running-off sheet of material 10, the severing knife is guided past a counter-knife 45 arranged centrally between the two sheet-holders. A severing cut is thereby made in the running-off sheet of material 10.

To execute the severing cut and to join the ends of the sheets of material 10 and 11 to one another, the sheet-holders 28, 29 are pivotable. Each sheet-holder can be pivoted out of the initial position shown by unbroken lines into the joining position shown by dot-and-dash lines FIG. 2. After the running-off sheet of material 10 has been severed in the way described, the rear sheet end which is then free is at the same time joined to the front end 38 by means of applied pressure. In the present case, the front end 38 is provided with a projecting adhesive tape 46 which makes the joint. The sheet-holder 28 is then moved back into the initial position. The emptied reel 12 or the reel core is now eliminated, and a new reel 12 is put into place and brought via the deflecting rollers 21 into the position of the sheet of material to be connected later, which is in the stand-by position, this being done manually. At the same time, the front end of the new reel 12 assumes the position shown in FIG. 2 in respect of the sheet of material 11. In the initial position, the sheet-holders 28, 29 rest against stops 47.

Figure 2:
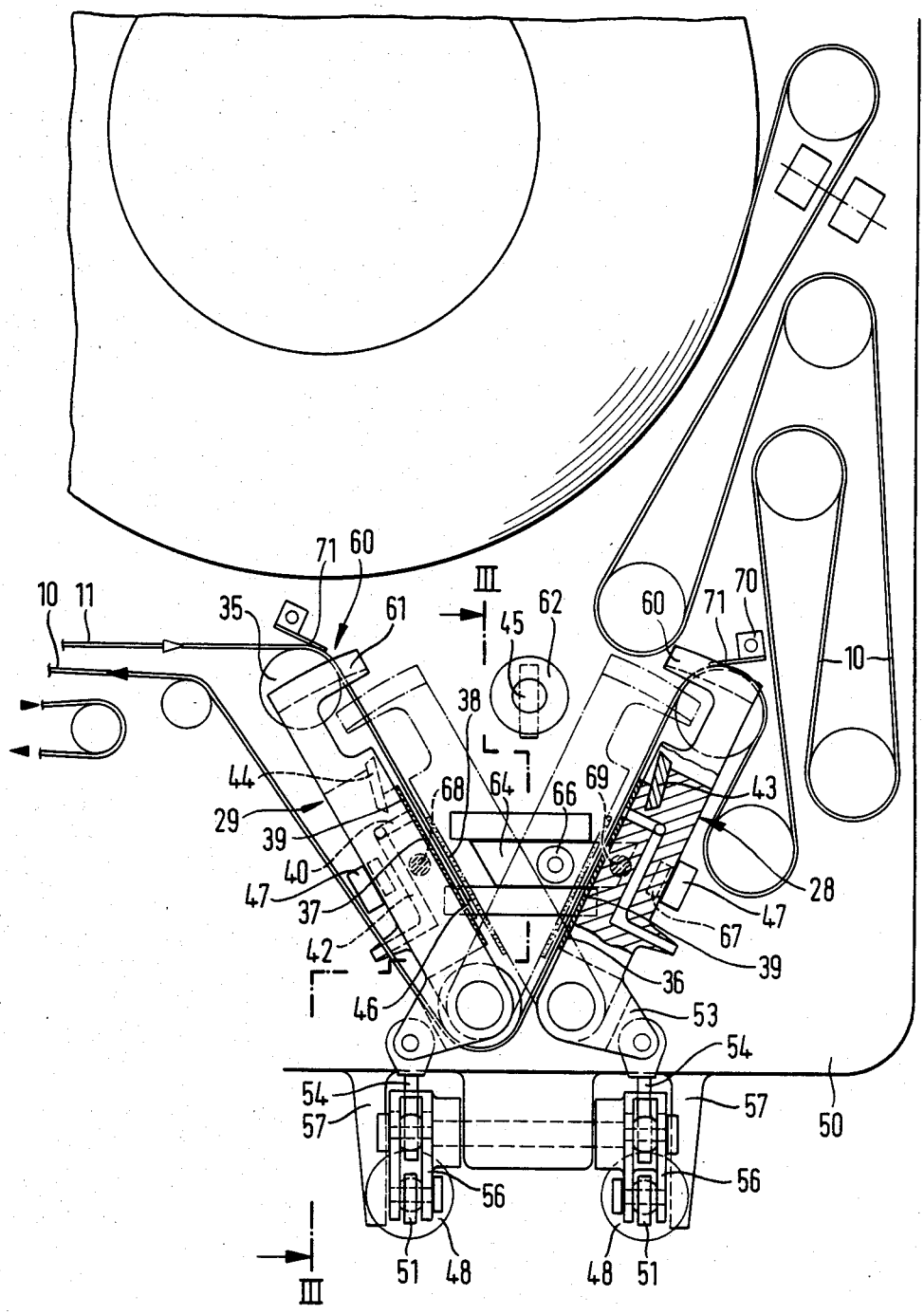
FIG. 2 shows a portion cut out from the apparatus on an enlarged scale.
Figure 3:
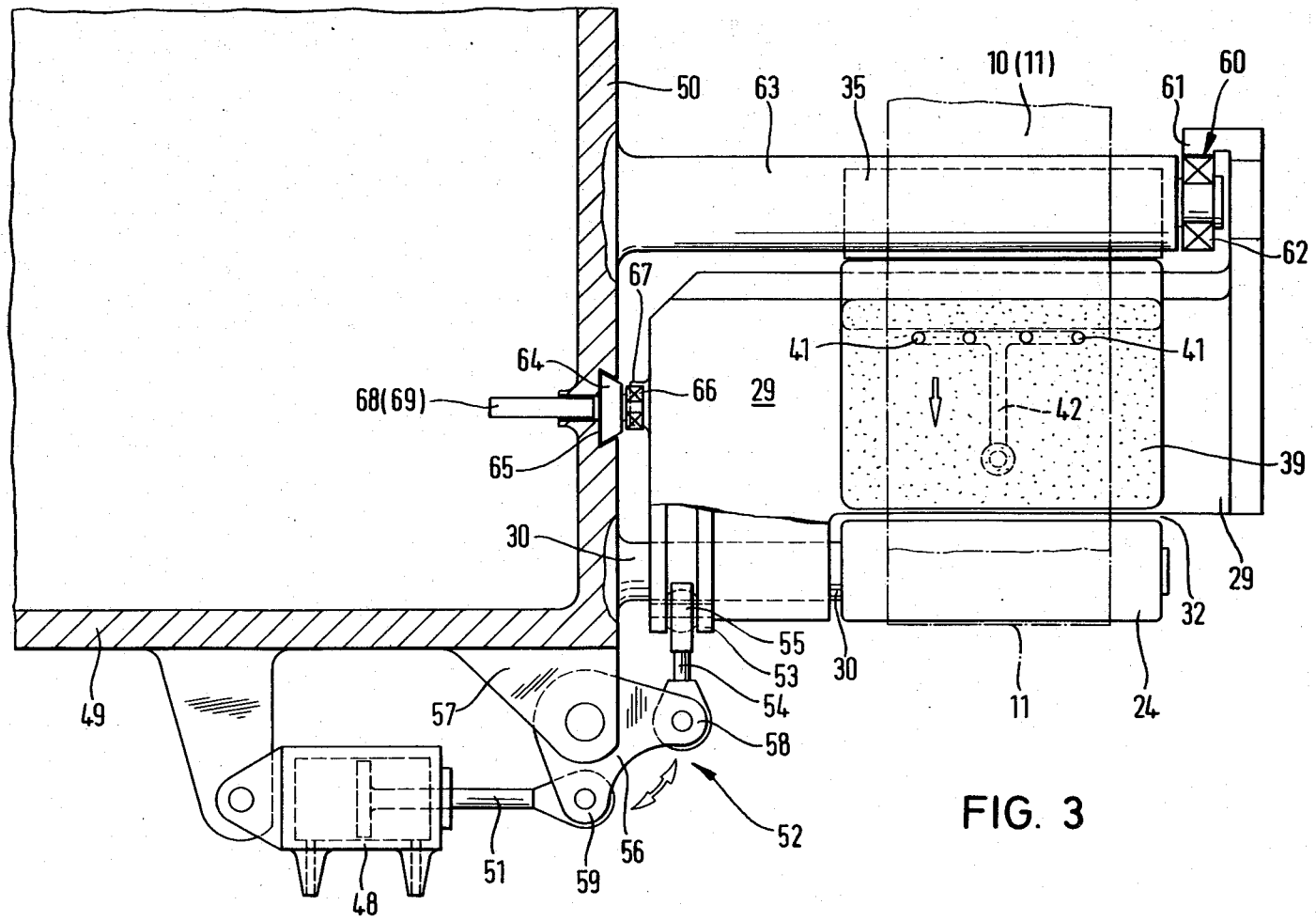
FIG. 3 shows a section through the detail of FIG. 2 in the plane III—III, on a further enlarged scale.

In the present case, the sheet-holders 28, 29 are actuated so as to pivot them by a pressure-medium cylinder 48 assigned to each sheet-holder. In the present case, the two pressure-medium cylinders 48 are arranged on the underside of a box-shaped or angular machine supporting part 49 to achieve the best possible utilisation of space. The sheet-holders 28, 29 are mounted in a (vertical) plane extending at right angles to this, in particular on a vertical supporting wall 50 (FIGS. 2 and 3). The movements of a piston rod 51 of the pressure-medium cylinder 48 are transmitted via a deflecting gear 52 to the sheet-holders 28, 29. These are provided laterally with triangular double shackles 53 which receive a tension and compression strut 54 with a joint 55. The tension and compression strut 54 in turn is mounted pivotably by means of its free end on a deflecting shackle 56. This is of approximately triangular design and is mounted pivotably on a shackle holder 57 connected to the machine supporting part 49. The tension and compression strut 54 is attached to one leg 58 of the deflecting shackle and the piston rod 51 to another leg 59 of the latter. Extending and retracting movements of the piston rod 51 produce pivoting movements of the deflecting shackle 56 in relation to the bearing on the shackle holder 57. The tension and compression strut 54 is thereby moved up and down, and this in turn results in a pivoting of one sheet-holder 28, 29 or the other in one direction or the other.

The sheet-holders 28 and 29 supported at one end in the region of the bearing journals 30, 31 are temporarily guided in the region of the fixed counter-knife 45, in such a way that there is always an exact relative position between the severing knife 43 or 44 on the one hand and the counter-knife 45 on the other hand. For this purpose, an arcuate or segment-like supporting and guide rail 60 is arranged laterally on the free edge of each of the sheet-holders 28, 29. This is of approximately C-shaped cross-section. A downward-pointing guide leg 61 is temporarily supported on a fixed supporting roller 62 which is mounted in the region of the counter-knife 45, in particular centrally relative to the latter. The supporting phase corresponds to the length of the supporting and guide rail. The supporting roller 62 is mounted on a supporting arm 63 connected to the supporting wall 50. The arrangement is such that the supporting and guide rails 60 run outside the region of the sheet of material 10, 11 and consequently also outside the deflecting rollers 24 or 34, 35.

Specific operations are started or ended as a result of the movement of the sheet-holders 28, 29. For this purpose, a switching means is actuated, in particular moved, by the sheet-holders 28, 29.

In the present case, a slide 64 is mounted laterally next to the sheet-holders 28, 29, in particular in or on the vertical supporting wall 50. Here, this slide 64 is of trapezoidal cross-section and is guided so as to slide in the manner of a dovetail in a matching groove 65 which is located in the supporting wall 50 and which has undercuts. On the side facing the sheet-holders 28, 29, the slide 64 is provided centrally with a stop roller 66. An engagement means 67 located on the side edge of each of the sheet-holders 28, 29 which faces it comes up against this stop roller 66. As a result, the slide 64 is shifted out of one end position (FIG. 2) into the other opposite end position.

In the end positions of the slide 64, switching operations are triggered. For this purpose, switching means, in the form of initiators 68, 69 stressed or actuated in a known way by the slide, are arranged there. Various operations are triggered when these initiators 68, 69 are actuated. The sensor unit 22 of the sheet of material 11, stationary until then, is activated in this way. At the same time, the sensor unit 23 of the sheet of material 10 which has run off is switched off or de-activated. Furthermore, the suction air in the region of the sheet-holder 29 is switched off, so that, after the sheet ends have been joined together, the sheet of material 11 can be conveyed unimpeded. The suction air of the sheet-holder 28 is switched on. Furthermore, a register, not shown or described in detail, is activated and causes a small number of packs to be ejected, among these being a pack which is defective because of the joining point of the sheets of material 10 and 11.

The sensor unit 23 of the particular sheet of material running off causes one pressure-medium cylinder 48 or the other to be actuated. After the sheet end markings indicative thereof, or a sheet defect has been sensed, the packaging machine is first slowed to crawling speed for a period of two to three machine cycles. One or other of the pressure-medium cylinders 48 is then actuated.

After the running sheet of material 10 has been severed from a sheet residue which is left behind, the latter is prevented from behaving in a disorganised manner, in the region of the deflecting roller 34, by a resillient rubber strip 70 which rests against the periphery of the deflecting roller 34 or against the sheet residue by means of an elastic spring leaf 71, in particular also made of rubber.

A lamp not shown in detail indicates that a reel change is now to be carried out in the region of the reel 12.

I claim:

1. Apparatus for joining a first running-off sheet of material to the front end of a second sheet of material, each sheet of material having assigned to it a pivotable sheet-holder, of which a first sheet-holder, fixing the first running-off sheet of material, is advanced to a second sheet-holder fixing a front end of the second sheet of material, to join the two sheets together, the first running-off sheet of material thereby being severed, the apparatus being characterized in that: the sheet-holders can be subjected to suction air for the temporary fixing of the respective sheets of material; in that the sheets of material each have assigned to them a monitoring means in form of photoelectric sensor units, which respond to end-of-sheet markings on the sheets of material in such a way that, when a marking is detected by the sensor unit assigned to the first running-off sheet of material, a signal is triggered and the associated sheet-holder is actuated to move toward the other sheet holder so that, as a direct result of the movement of one sheet-holder or the other, a slide (64) is directly moved to and fro by a sheet-holder between two end position to operate one of two switches respectively located at the two end positions; and in that the operation of said one switch causing the sensor unit assigned to the second sheet of material to be switched on and the sensor unit assigned to the first sheet of material to be switched off, and the suction air of the first sheet-holder (28) to be switched on and the suction air of the second sheet-holder to be switched off.

2. Apparatus according to claim 1, characterised in that the slide movable to and fro is arranged in a guide (groove 65) of a vertical supporting wall (50) and is directly moved by engagement means (67) on the sides of the sheet-holders (28, 29) via a stop roller (66).

3. Apparatus according to claim 1, characterised in that the sheet-holders comprise severing knives (43, 44) which are guided, in the region of a centrally arranged, stationary, common counter-knife (45), by means of a fixed supporting roller (62), on which an arcuate supporting and guide rail (60), attached to the sheet-holder (28, 29), runs during the severing operation.

4. Apparatus according to claim 1, characterised in that the sheet-holders (28, 29) are provided, on the side facing the sheet of material (10, 11), with an elastic covering, in the form of a rubber coating (39), which possesses holes (41) in the region of suction bores (40).

* * * * *